US010132589B1

(12) United States Patent
Anderson

(10) Patent No.: US 10,132,589 B1
(45) Date of Patent: Nov. 20, 2018

(54) AMBIDEXTROUS COMPACT FIREARM

(71) Applicant: John Carnan Anderson, Lubbock, TX (US)

(72) Inventor: John Carnan Anderson, Lubbock, TX (US)

( * ) Notice: Subject to any disclaimer, the term of this patent is extended or adjusted under 35 U.S.C. 154(b) by 0 days.

(21) Appl. No.: 16/012,456

(22) Filed: Jun. 19, 2018

Related U.S. Application Data

(60) Provisional application No. 62/522,924, filed on Jun. 21, 2017.

(51) Int. Cl.
*F41A 35/06* (2006.01)
*F41A 3/66* (2006.01)
*F41A 9/65* (2006.01)

(52) U.S. Cl.
CPC ..... *F41A 35/06* (2013.01); *F41A 3/66* (2013.01); *F41A 9/65* (2013.01)

(58) Field of Classification Search
CPC ..... F41A 35/06; F41A 17/36; F41A 17/38; F41A 3/66; F41A 11/02; F41A 9/65
See application file for complete search history.

(56) References Cited

U.S. PATENT DOCUMENTS 512,437 A 1/1894 Griffiths et al.
783,123 A 2/1905 Mauser
1,096,324 A 5/1914 Stamm
5,710,389 A 1/1998 Canaday
6,079,138 A 8/2000 Meeker
6,250,194 B1 * 6/2001 Brandl ..... F41A 19/18 42/71.01
7,299,737 B2 11/2007 Hajjar et al.
8,839,709 B1 9/2014 Crye et al.
9,541,339 B2 * 1/2017 Orne, III ..... F41A 3/72
2003/0150322 A1 8/2003 Barrett
2005/0257682 A1 11/2005 Hajjar et al.
2011/0283582 A1 * 11/2011 Hunter ..... F41A 19/10 42/69.02
2017/0067715 A1 * 3/2017 Conant ..... F41C 7/02
2018/0195822 A1 * 7/2018 Jonsson ..... F41A 11/02

OTHER PUBLICATIONS

Internet website: http://guns.wikia.com/wiki/Category:Terminology, Gun Wiki, Dec. 6, 2010.*

* cited by examiner

*Primary Examiner* — Benjamin P Lee

(74) *Attorney, Agent, or Firm* — Sarah Hegi Simpson; McWhorter, Cobb & Johnson, LLP

(57) ABSTRACT

An ambidextrous compact firearm is disclosed. The firearm provides for ambidextrous use by providing two interchangeable receiving wells that are arranged and configured to interchangeably receive a releasably attachable magazine and a releasably attachable fire control group.

27 Claims, 18 Drawing Sheets

AMBIDEXTROUS COMPACT FIREARM

CROSS-REFERENCE TO RELATED APPLICATIONS

This application is related to and claims priority from earlier filed U.S. Provisional Patent Application No. 62/522,924, filed Jun. 21, 2017, the disclosure of which is incorporated herein by reference.

BACKGROUND OF THE INVENTION

1. Field of the Invention

The present invention relates generally to the field of firearms, and more specifically to ambidextrous compact firearms, such as shotguns.

2. Description of Related Art

Often operating in confined environments, military and police forces frequently require compact firearms to perform their job duties. A common close quarters combat weapon used by law enforcement and military personnel is a shotgun. By their nature, shotguns are close range weapons having a limited range and substantial stopping power. Conventional shotguns, however, are relatively long and create maneuverability problems in limited spaces.

In view of the foregoing, it is apparent that a need exists in the art for a compact firearm which overcomes, mitigates or solves the above problems in the art. It is a purpose of this invention to fulfill this and other needs in the art which will become more apparent to the skilled artisan once given the following disclosure.

OBJECTS AND SUMMARY OF THE INVENTION

It is an object of the present invention to overcome the above described drawbacks associated with current firearms. To achieve these and other advantages and in accordance with the purpose of the invention, as embodied and broadly described, the present disclosure describes an ambidextrous compact firearm, such as a semi-automatic shotgun.

The disclosed compact firearm generally comprises a barrel, a receiver and a stock. The firearm further comprises two interchangeable receiving wells that are arranged and configured to interchangeably receive a releasably attachable magazine and a releasably attachable fire control group. Disposing the magazine and the fire control group side-by-side, rather than in alignment with the longitudinal axis of the firearm, provides for a more compact firearm.

By providing two interchangeable receiving wells that are arranged and configured to interchangeably receive a releasably attachable magazine and a releasably attachable fire control group, the disclosed firearm provides for ambidextrous use. A right-handed user can insert and attach the fire control group in the rightmost interchangeable receiving well and the right-handed user can insert and attach the magazine in the leftmost interchangeable receiving well. A left-handed user, on the other hand, can insert and attach the fire control group in the leftmost interchangeable receiving well and the left-handed user can insert and attach the magazine in the rightmost interchangeable receiving well. In this manner, the disclosed compact firearm provides for ambidextrous use.

Currently, a need exists for a firearm that is designed to be maneuverable when used inside buildings and other confined spaces. Additionally, a compact firearm is needed that retains the firepower, features and components of a conventional shotgun. Furthermore, a firearm is needed that provides for ambidextrous use. Therefore, one of the primary objectives of the current disclosure is to disclose a firearm design that is compact, easy to manipulate and carry in confined spaces, and which can be operated ambidextrously.

These, together with other objects of the invention, along with various features of novelty that characterize the invention, are pointed out with particularity in the claims annexed hereto and forming a part of this disclosure. For a better understanding of the invention, its operating advantages, and the specific objects attained by its uses, reference should be had to the accompanying drawings and descriptive matter in which there is described illustrative embodiments of the invention.

BRIEF DESCRIPTION OF THE DRAWINGS

The accompanying drawings, which are incorporated in and forma part of the specification, illustrate embodiments of the present invention, and together with the description, serve to explain the principles of the invention. It is to be expressly understood that the drawings are for the purpose of illustration and description only and are not intended as a definition of the limits of the invention. In the drawings.

DETAILED DESCRIPTION OF ILLUSTRATIVE EMBODIMENTS

Referring now to FIGS. 1-18, exemplary embodiments of an ambidextrous compact firearm 20 and methods of use in accordance with the present disclosure are illustrated.

Figure 1:
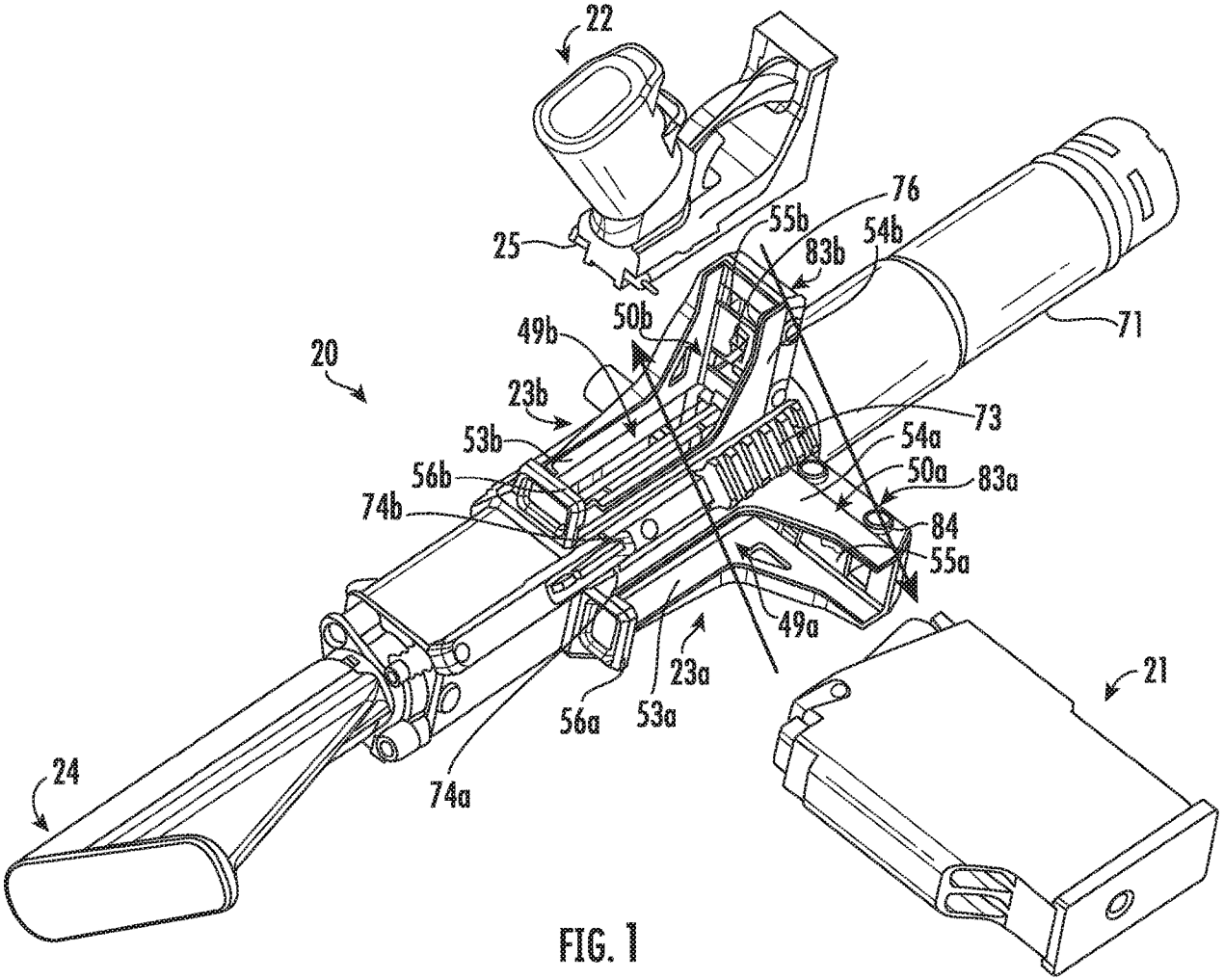
FIG. 1 is a bottom perspective view of an ambidextrous compact firearm constructed in accordance with the teachings of the present disclosure.

Turning to the Figures for illustrative purpose, FIG. 1 is a bottom perspective view of an ambidextrous compact firearm 20 according to the present disclosure. The firearm 20 generally includes a barrel 43; a receiver 63 coupled to the barrel 43; a first interchangeable receiving well 23*a* coupled to the receiver 63, said first interchangeable receiving well 23*a* being arranged and configured to interchangeably receive a releasably attachable magazine 21 and a releasably attachable fire control group 22; and a second interchangeable receiving well 23*b* coupled to the receiver 63, said second interchangeable receiving well 23*b* being arranged and configured to interchangeably receive the releasably attachable magazine 21 and the releasably attachable fire control group 22. The first interchangeable receiving well 23*a* and the second interchangeable receiving well 23*b* are identical and each comprise a first side track 53*a* or 53*b*; a second side track 54*a* or 54*b* opposite the first side track 53*a* or 53*b*, wherein the second side track 54*a* or 54*b* extends parallel to the first side track 53*a* or 53*b*; a forward track 55*a* or 55*b* connecting the first side track 53*a* or 53*b* and the second side track 54*a* or 54*b*; a rear track 56*a* or 56*b* connecting the first side track 53*a* or 53*b* and the second side track 54*a* or 54*b*, wherein the rear track 56*a* or 56*b* is opposite of and extends parallel to the forward track 55*a* or 55*b*; and a receiving cavity 49*a* or 49*b* formed inside the first side track 53*a* or 53*b*, the forward track 55*a* or 55*b*, the second side track 54*a* or 54*b* and the rear track 56*a* or 56*b*, wherein the receiving cavity 49*a* or 49*b* is arranged and configured to interchangeably receive the magazine 21 and the fire control group 22.

As shown in the attached drawings, the barrel 43 may be coupled to the receiver 63 by a threadably affixed barrel shroud 71. The barrel shroud 71 is a covering that encircles the barrel 43 and protects users from directly contacting a hot barrel. The barrel 43 includes a breech end 91 at which a chamber 72 is provided. A forward end of the receiver 63 is coupled to the breech end 91 of the barrel 43.

Figure 2:
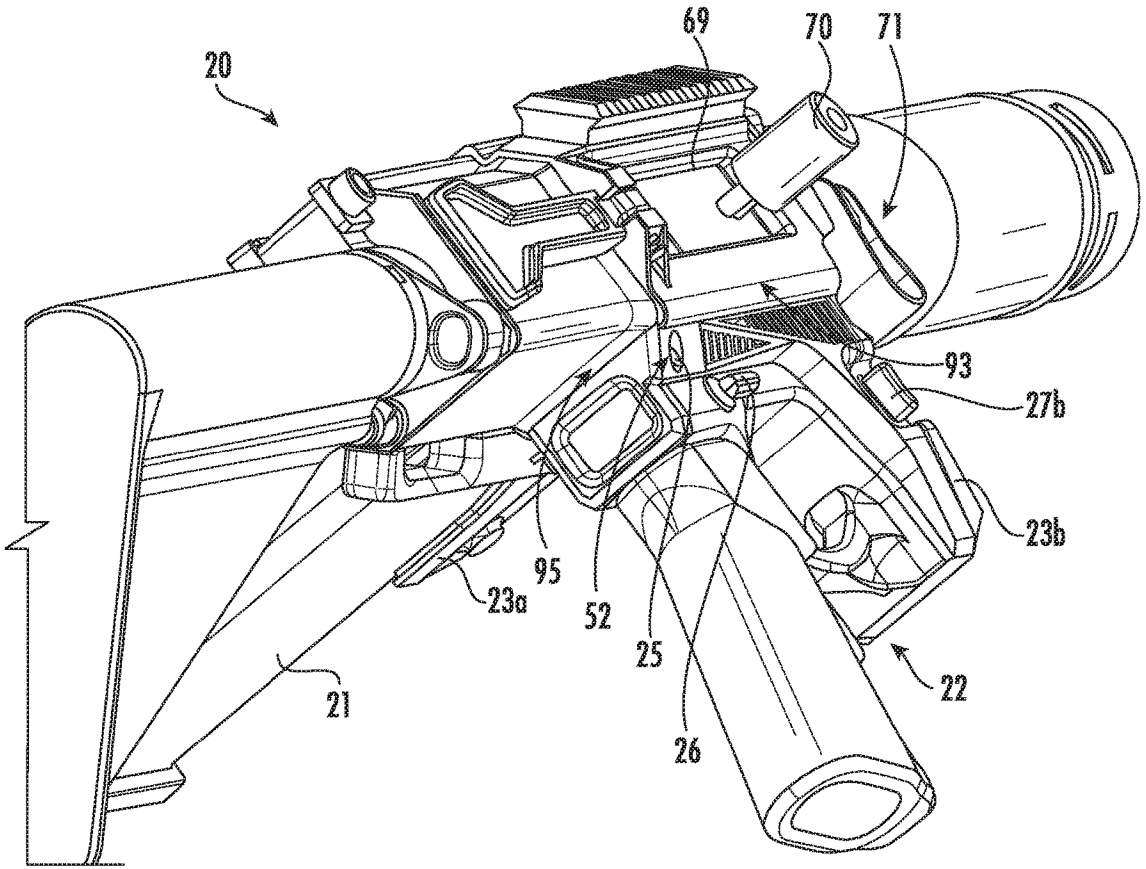
FIG. 2 is a right side rear perspective view of the firearm shown in FIG. 1.
Figure 3:
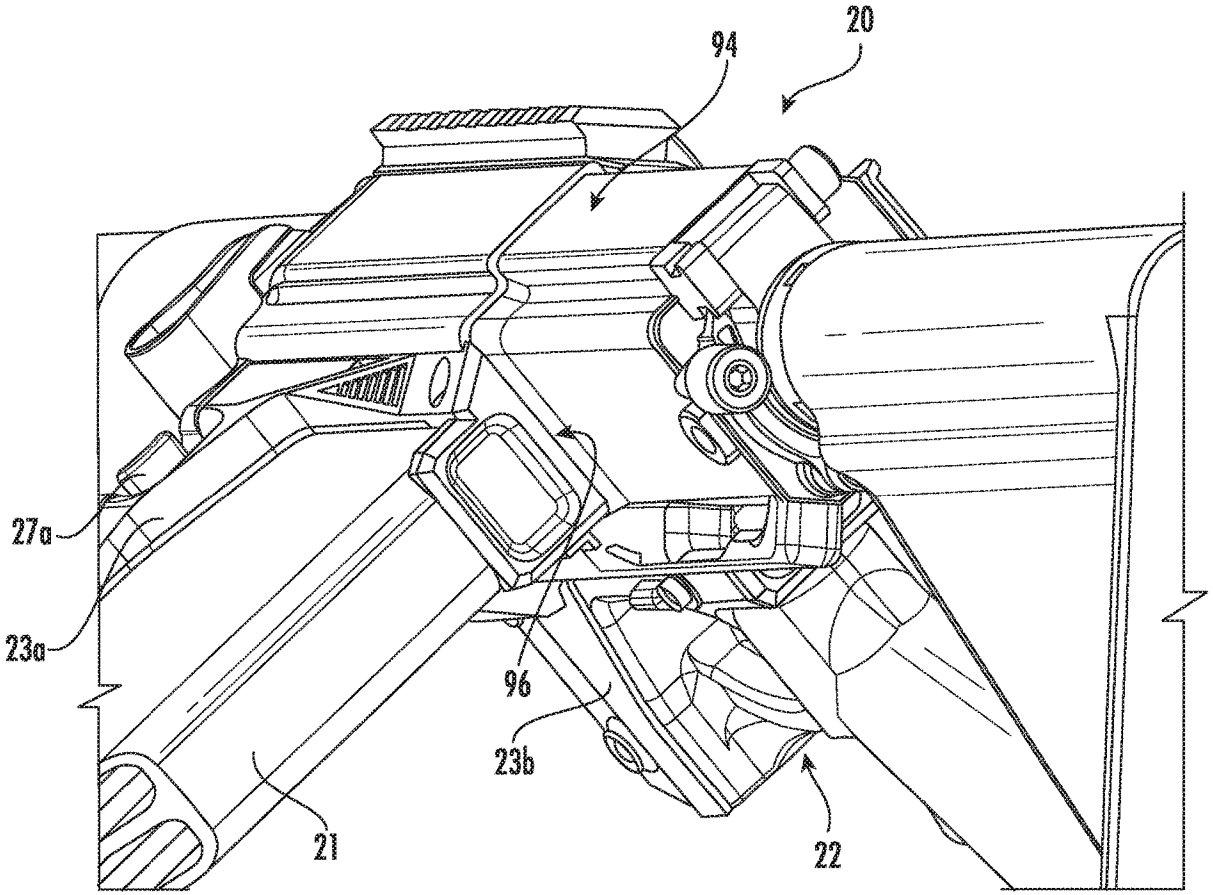
FIG. 3 is a partial left side rear perspective view of the firearm shown in FIG. 1.
Figure 4:
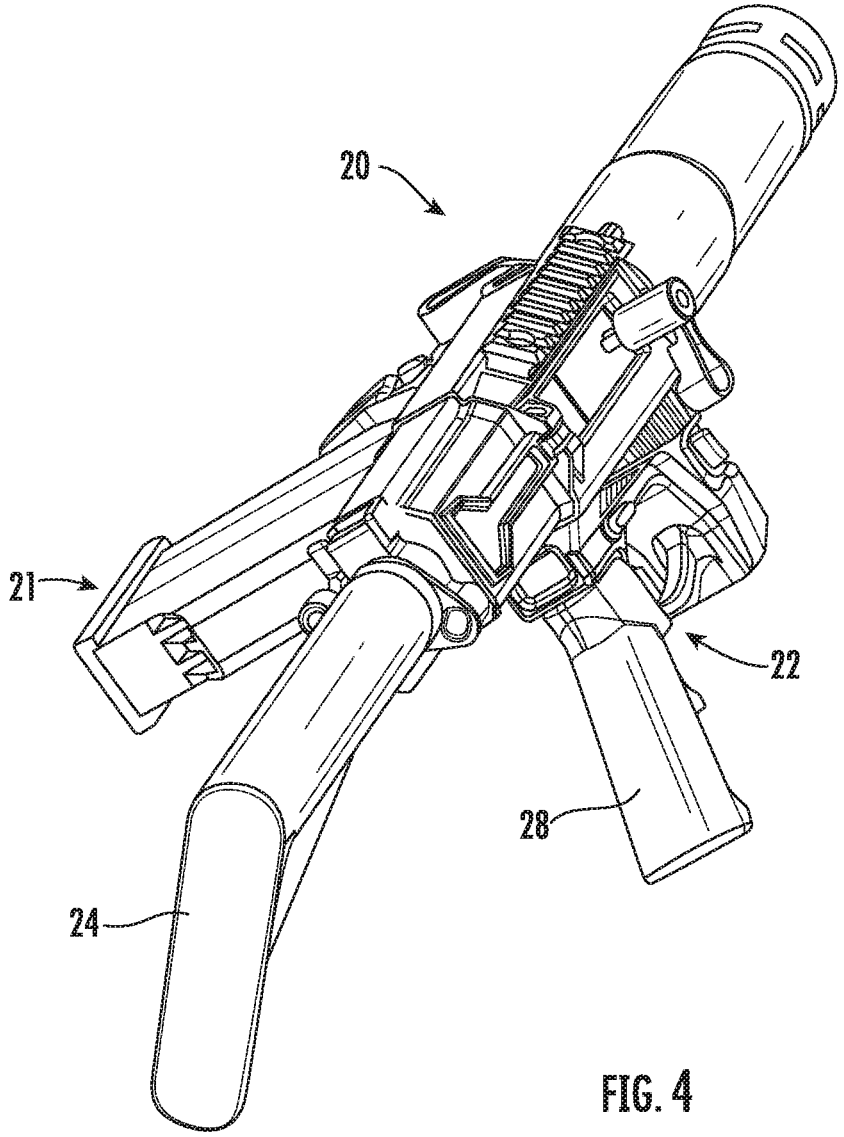
FIG. 4 is a top rear perspective view of the firearm shown in FIG. 1.
Figure 5:
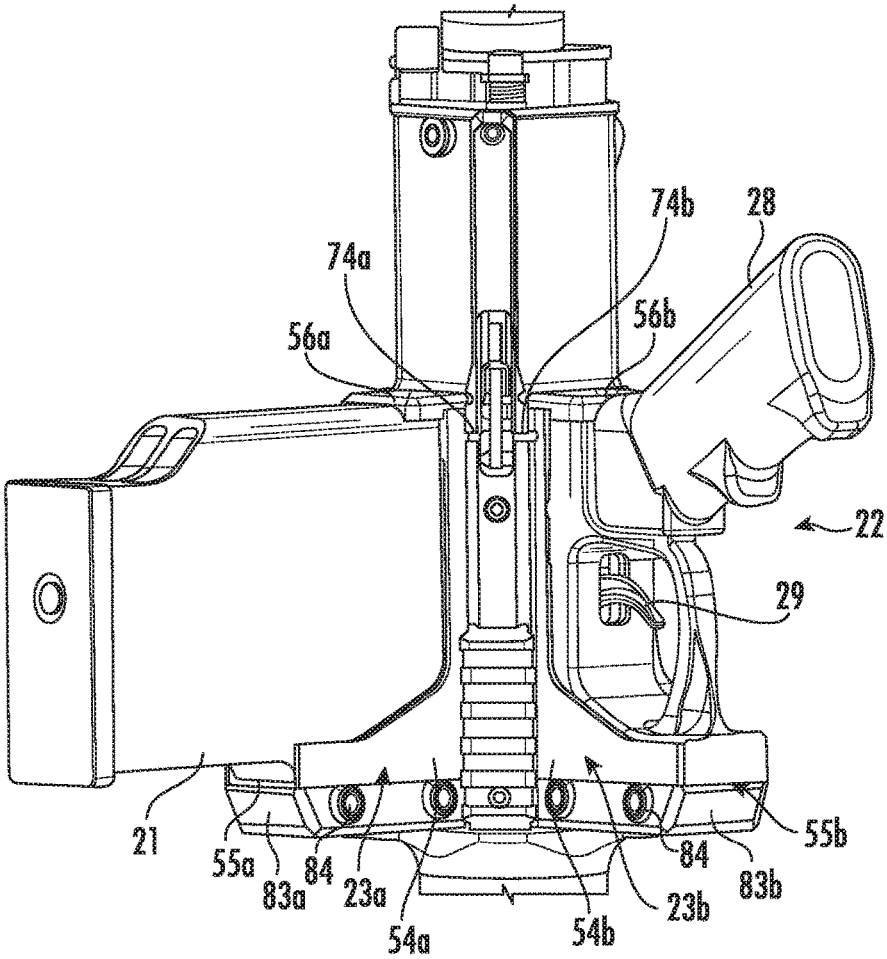
FIG. 5 is partial bottom perspective view of the firearm shown in FIG. 1.

As illustrated in FIGS. 1-4, the receiver 63 of the firearm 20 may be configured in a rectangular shape. In this embodiment, viewed from the rear of the firearm 20, as shown in FIGS. 2 and 3, the receiver 63 is oriented in a diamond shape, having an upper right-hand flat 93, an upper left-hand flat 94, a lower right-hand flat 95 and a lower left-hand flat 96. The upper left-hand flat 94 provides an area onto which the stock 24 of the firearm 20 can fold, and an ejection port 69 and a bolt handle 70 may be disposed on the upper right-hand flat 93. The first interchangeable receiving well 23*a* is disposed on the lower left-hand flat 96 and the second interchangeable receiving well 23*b* is disposed on the lower right-hand flat 95. As depicted in FIGS. 1-4, the uppermost and lowermost vertices of the diamond-shaped receiver 63 can be made flat allowing for the attachment of common mounting systems such as picatinny rails 73 and/or sling mounts. It is also anticipated that the receiver 63 may be configured in other shapes, including a cylindrical shape. Regardless of the shape of the receiver 63, the receiver 63 preferably includes sides with an ejection port 69 defined in one of the sides for ejecting spent casings after firing. The receiver 63 also includes a port defined in the bottom surface thereof for receiving cartridges 37 for loading into the chamber 72. The receiver 63 further includes an action, such as a bolt (as shown in FIGS. 9-12), that operates to move cartridges 37 from the magazine 21 into the chamber 72 formed within the breech end of the firearm 20.

To provide for ambidextrous use of the disclosed firearm 20, the first interchangeable receiving well 23*a* is identical to the second interchangeable receiving well 23*b*, and each interchangeable receiving well is configured to separately receive and releasably retain a magazine 21 of cartridges and a fire control group 22. The first interchangeable receiving well 23*a* and the second interchangeable receiving well 23*b* are affixed to the receiver 63 in side-by-side relation at the same location along the longitudinal axis of the receiver 63. In one preferred embodiment of the disclosed firearm 20, the first and second interchangeable receiving wells 23*a* and 23*b* are affixed to a forward portion of the receiver 63.

The first interchangeable receiving well 23*a* includes a body 50*a* and a receiving cavity 49*a* formed within the body 50*a*. The body 50*a* of the first interchangeable receiving well 23*a* includes a front or forward tract 55*a* that extends outwardly below the breech face 91 of the firearm 20. The body 50*a* of the first interchangeable receiving well 23*a* further includes a back or rear track 56*a* that extends outwardly from the receiver 63, wherein the rear track 56*a* is opposite of and extends parallel to the forward track 55*a*. The body 50*a* of the first interchangeable receiving well 23*a* further includes a first side track 53*a* that extends outwardly from the receiver 63 and connects the forward track 55*a* and the rear track 56*a*. The body 50*a* of the first interchangeable receiving well 23*a* further includes a second side track 54*a* that extends outwardly from the receiver 63 and connects the forward track 55*a* and the rear track 56*a*, wherein the second side track 54*a* is opposite of and extends parallel to the first side track 53*a*. Finally, the first interchangeable receiving well 23*a* further includes a receiving cavity 49*a* formed as a cavity surrounded by the forward track 55*a*, the first side track 53*a*, the rear track 56*a* and the second side track 54*a*, wherein the receiving cavity 49*a* is arranged and configured to interchangeably receive the magazine 21 and the fire control group 22. The body 50*a* of the first interchangeable receiving well 23*a* may further include a tab 57 to prevent over-insertion of the fire control group 22 or over-insertion of the magazine 21 in the interchangeable receiving well. The body 50*a* of the first interchangeable receiving well 23*a* may further include a first mounting base 83*a* disposed in front of the forward tract 55*a*, wherein the first mounting base 83*a* extends outwardly and is affixed to the firearm 20 in front of the breech face 91 of the firearm 20. The first mounting base 83*a* is arranged and configured for attachment of the forward track 55*a* thereto.

Figure 7:
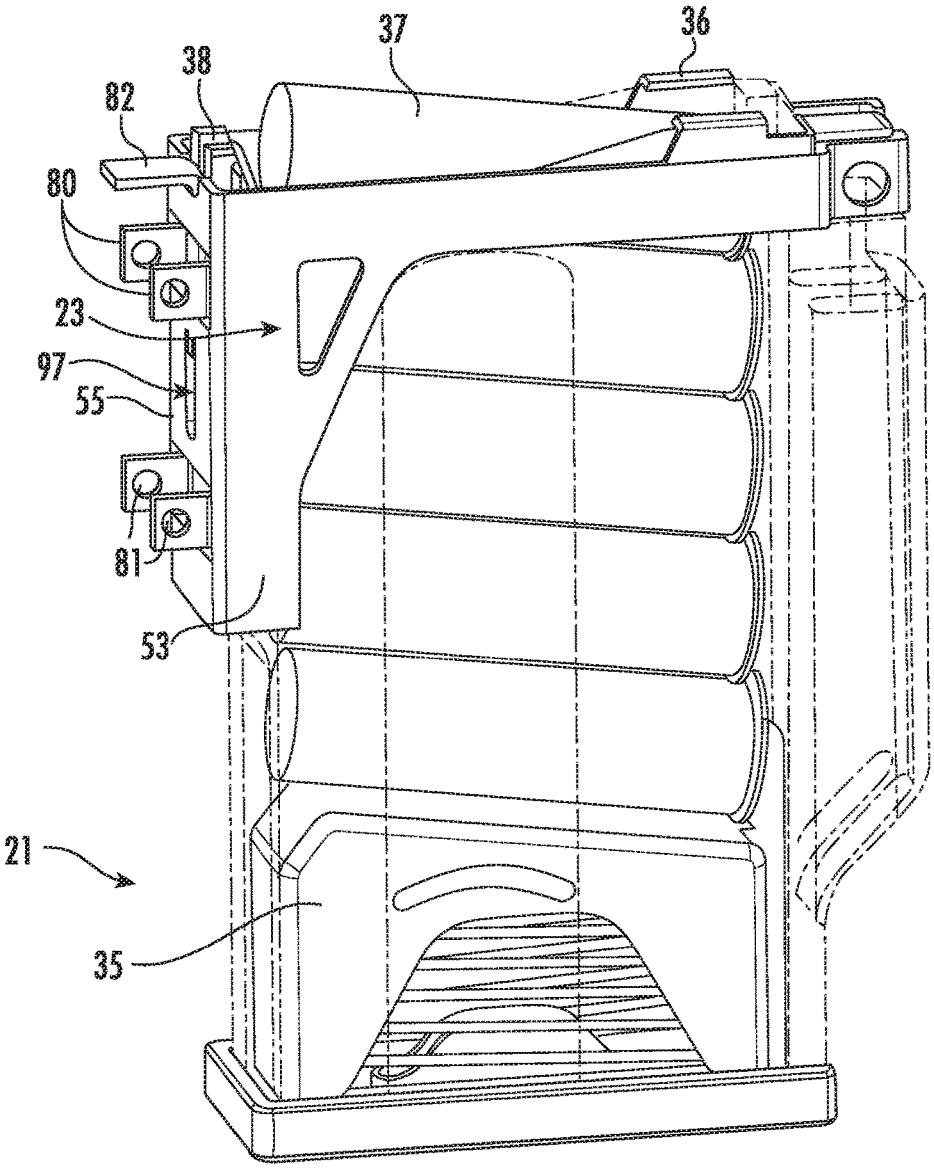
FIG. 7 is a side perspective view of a magazine, which is releasably attachable to the firearm shown in FIG. 1.

FIG. 7 shows an interchangeable receiving well 23 attached to a magazine 21. Please note, the interchangeable receiving well 23 preferably remains attached to the firearm 20 at all times. FIG. 7 shows the interchangeable receiving well 23*a* detached from the firearm 20 and attached to the magazine 21 simply for illustrative purposes. As shown in FIG. 7, the interchangeable receiving well 23 includes a first side track 53*a* or 53*b*, a second side track 54*a* or 54*b* and a forward track 55*a* or 55*b*. The forward track 55*a* or 55*b* further includes a coupling tongue member 82 and coupling tabs 80 for coupling the interchangeable receiving well to a mounting base 83*a* or 83*b*. The coupling tabs 80 may include apertures 81 therethrough, wherein the apertures 81 are arranged and configured to receive a fastener 84 therethrough in order to fasten the coupling tabs 80 to the mounting base 83*a* or 83*b*. Furthermore, as can be seen in FIGS. 9-14, one or more of the coupling tabs 80 may be arranged and configured for attachment of a receiving well retention and release fastener 58, such as the lever shown in the drawings. The receiving well retention and release fastener or lever 58 is arranged and configured to either retain the magazine 21 or fire control group 22 in engagement with the interchangeable receiving well 23, or to release the magazine 21 or fire control group 22 from engagement with the interchangeable receiving well 23. The receiving well retention and release fastener 58 may be configured as a conventional spring-loaded magazine release lever, as is well known in the art, or it may be configured as magazine release push button or any other conventional magazine release known to those skilled in the art. As illustrated in FIG. 7, the forward track 55*a* or 55*b* may further include an aperture 97 for receiving a head 76 of the receiving well retention and release lever 58. In this embodiment, shown in FIGS. 9-14, the head 76 of the receiving well retention and release lever 58 couples with the magazine 21 or fire control group 22 inserted in the interchangeable receiving well 23 in order to secure the magazine 21 or fire control group 22 in the interchangeable receiving well 23. Subsequently, when a user desires to detach the magazine 21 or fire control group 22 from the interchangeable receiving well 23, a receiving well release button 27*a* or 27*b*, or the like, is actuated in order to disengage the receiving well retention and release fastener 58 from engagement with the magazine 21 or fire control group 22, thereby allowing a user to simply slide the magazine 21 or fire control group 22 downwardly in order to detach the magazine 21 or the fire control group 22 from the interchangeable receiving well 23.

Identical to the first interchangeable receiving well 23*a*, the second interchangeable receiving well 23*b* includes a body 50*b* and a receiving cavity 49*b* formed within the body 50*b*. The body 50*b* of the second interchangeable receiving well 23*b* includes a front or forward tract 55*b* that extends outwardly below the breech face 91 of the firearm 20. The body 50*b* of the second interchangeable receiving well 23*b* further includes a back or rear track 56*b* that extends outwardly from the receiver 63, wherein the rear track 56*b* is opposite of and extends parallel to the forward track 55*b*. The body 50*b* of the second interchangeable receiving well 23*b* further includes a first side track 53*b* that extends outwardly from the receiver 63 and connects the forward track 55*b* and the rear track 56*b*. The body 50*b* of the second interchangeable receiving well 23*b* further includes a second side track 54*b* that extends outwardly from the receiver 63 and connects the forward track 55*b* and the rear track 56*b*, wherein the second side track 54*b* is opposite of and extends parallel to the first side track 53*b*. Finally, the second interchangeable receiving well 23*b* further includes a receiving cavity 49*b* formed as a cavity surrounded by the forward track 55*b*, the first side track 53*b*, the rear track 56*b* and the second side track 54*b*, wherein the receiving cavity 49*b* is arranged and configured to interchangeably receive the magazine 21 and the fire control group 22. The body 50*a* of the second interchangeable receiving well 23*b* may further include a tab 57 to prevent over-insertion of the fire control group 22 or over-insertion of the magazine 21 in the interchangeable receiving well. The body 50*b* of the second interchangeable receiving well 23*b* may further include a second mounting base 83*b* disposed in front of the forward tract 55*b*, wherein the second mounting base 83*b* extends outwardly and is affixed to the firearm 20 in front of the breech face 91 of the firearm 20. The second mounting base 83*b* is arranged and configured for attachment of the forward track 55*b* thereto.

Figure 6:
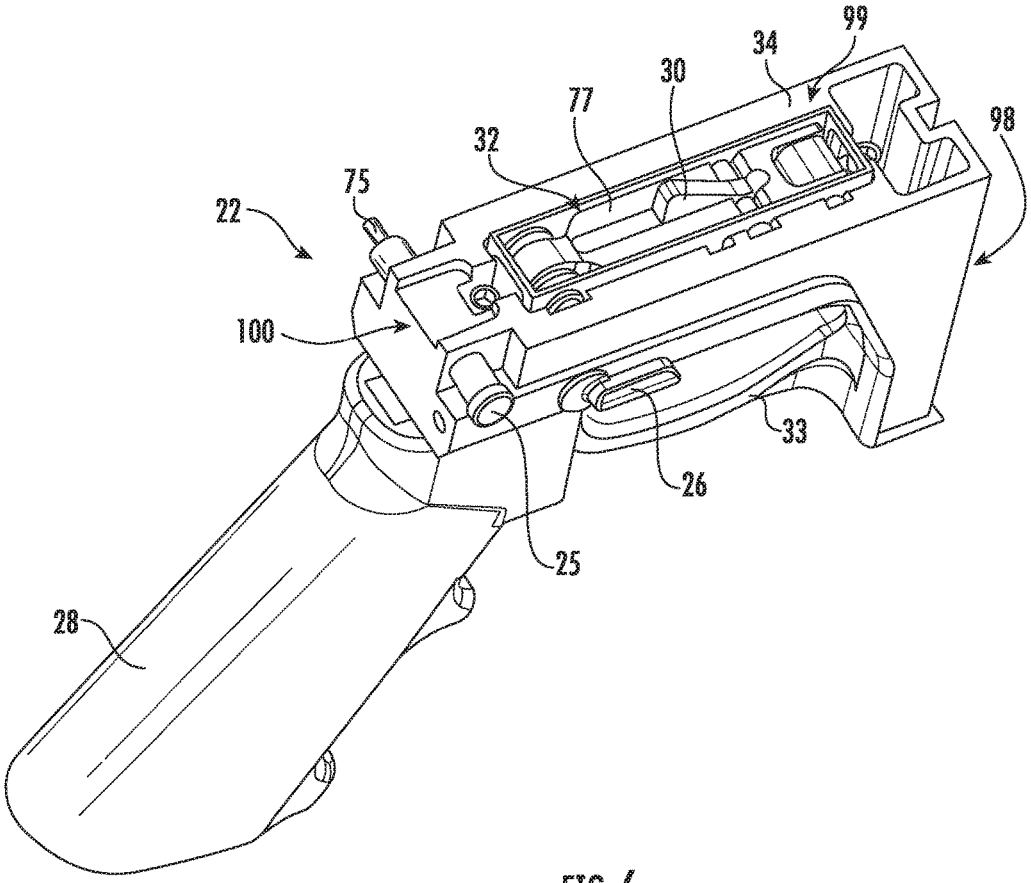
FIG. 6 is a side perspective view of a fire control group, which is releasably attachable to the firearm shown in FIG. 1.

Turning to FIG. 6, a fire control group 22 is illustrated and generally comprises a trigger group 32 including a trigger 29, a safety 26, a sear 30, a disconnector 40, and a bar 77 connecting the sear 30 and disconnector 40; a handgrip 28; and a mating frame 34; wherein the handgrip 28 is attached to the mating frame 34 and the mating frame 34 houses the trigger group 32. As shown in the attached drawings, the fire control group 22 may further comprise a trigger guard 33. The mating frame 34 is arranged and configured for interchangeably mating with both the first interchangeable receiving well 23*a* and the second interchangeable receiving well 23*b*. The mating frame 34 comprises a forward face 98 arranged and configured to couple with the receiving well retention and release fastener 58, a top face 99 arranged and configured to couple with the receiver 63 of the firearm 20, and a rear portion 100. The rear portion 100 of the mating frame 34 may include an aperture configured to receive a fire control group retaining pin 25 therethrough. In addition to being retained in an interchangeable receiving well 23 by coupling with the receiving well retention and release fastener 58, the fire control group 22 further may be retained in the interchangeable receiving well 23 by a retaining pin 25. The retaining pin 25 can be inserted through an aperture 52 formed through the first side track 53*a* or 53*b* of the interchangeable receiving well 23, then the retaining pin 25 can be inserted through an aperture formed through the rear portion 100 of the mating frame 34 of the fire control group 22, and finally the retaining pin 25 can be inserted through an aperture formed through the second side track 54*a* or 54*b* of the interchangeable receiving well 23. In such an embodiment, the retaining pin 25 must be withdrawn and the receiving well retention and release fastener 58 must be disengaged from the fire control group 22 in order to detach the fire control group 22 from the interchangeable receiving well 23. On the bottom portion of the firearm 20 between the first interchangeable receiving well 23*a* and the second interchangeable receiving well 23*b*, the firearm 20 may further include a receiving slot 74*a* or 74*b*, for receiving the end portion 75 of the fire control group 22 retaining pin 25.

Figure 8:
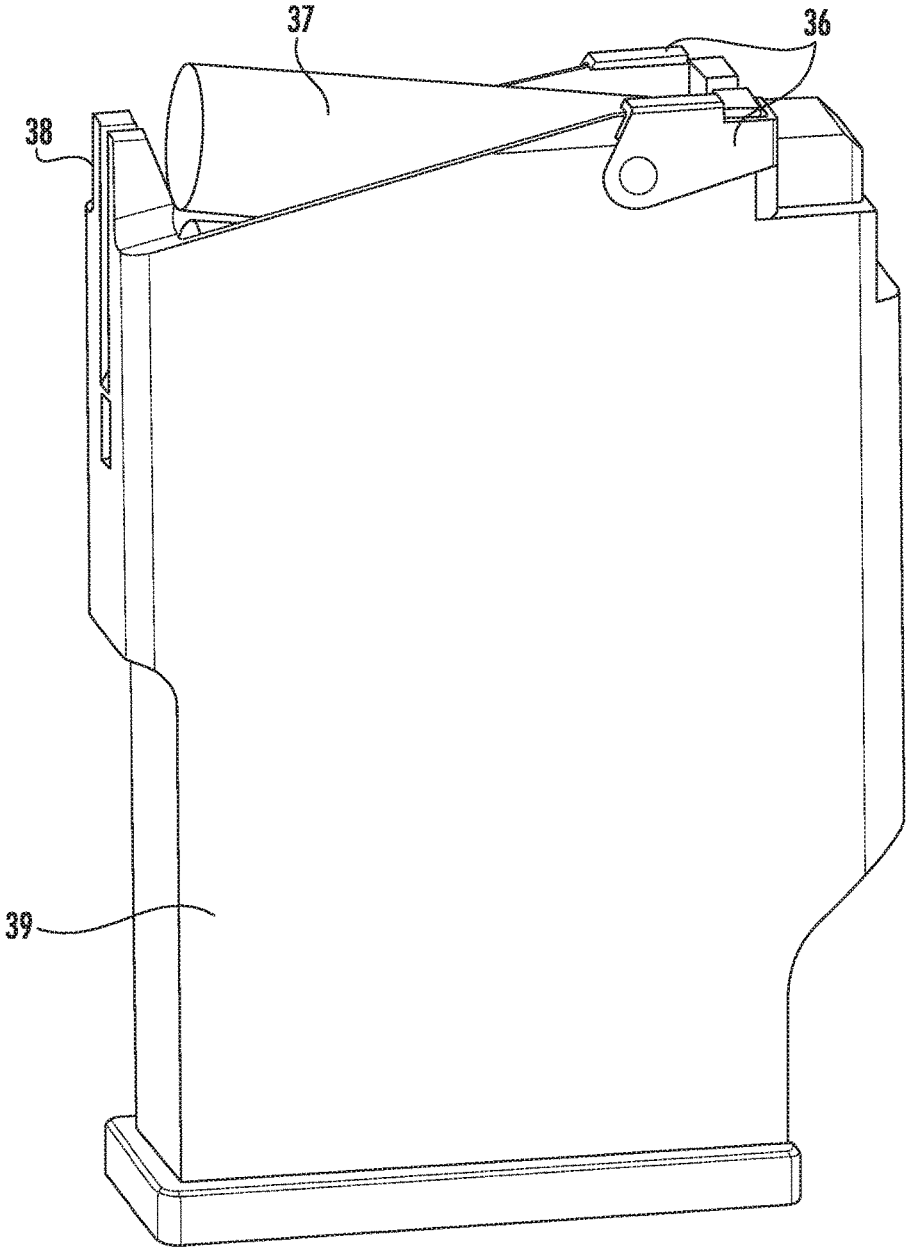
FIG. 8 is a side perspective view of a magazine, which is releasably attachable to the firearm shown in FIG. 1.
Figure 9:
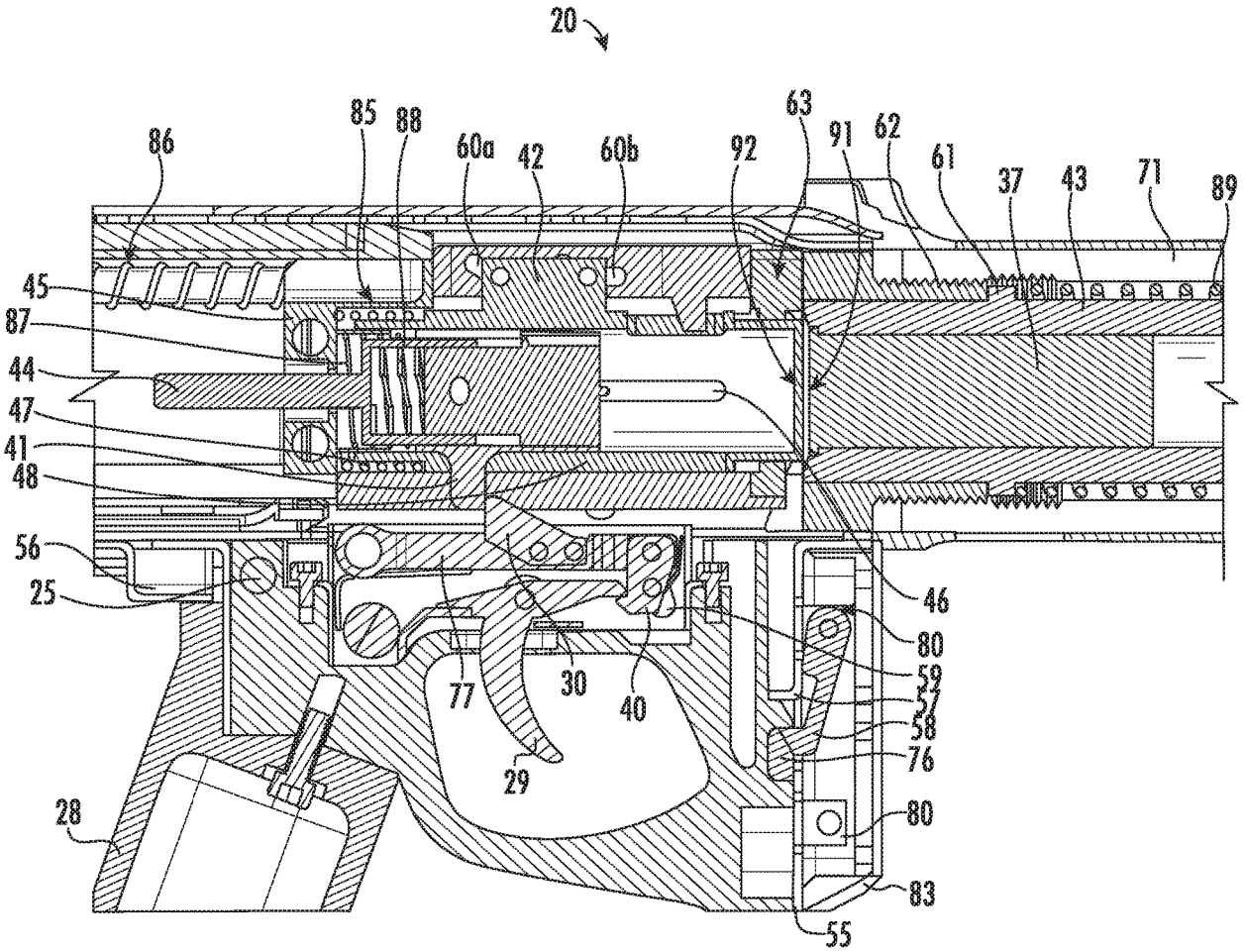
FIG. 9 is a partial side sectional view of an ambidextrous compact firearm constructed in accordance with the teachings of the present disclosure.

Turning to FIGS. 7 and 8, a magazine 21 is illustrated and generally comprises a magazine box or magazine body 39, a magazine follower assembly 35 for advancing cartridges 37 towards the top of the magazine body 39, magazine feed lips 36, a magazine feed ramp 38, and one or more cartridges 37 housed inside the magazine body 39. The magazine 21 can be releasably attached to the first interchangeable receiving well 23*a* or to the second interchangeable receiving well 23*b* for feeding cartridges 37 from the magazine 21 into the receiver 63. When the magazine 21 is emptied, it can be detached from the interchangeable receiving well 23 and refilled with cartridges 37, or the emptied magazine can be replaced with another preloaded magazine.

In one preferred embodiment anticipated by the present disclosure, the firearm 20 further includes a stock 24 coupled to the back end of the receiver 63. The stock 24 may be configured as a presently available stock common to AR-15 style rifles, such as a variable position stock that is slidable and lockable at various positions. The stock 24 may be coupled to the receiver 63 by utilizing a well-known threaded attachment system. The stock 24 can be locked into a collapsed position or locked into a fully extended position depending on the needs of the user.

The following discussion will describe how the disclosed firearm 20 may be used in accordance with one detailed operating method. It should be appreciated and understood that the disclosed firearm 20 may utilize other operating methods and actions including, but not limited to, a bolt action, a blowback action, a gas-delayed action, etc., and still accomplish the objectives described herein.

Turning to FIGS. 9-12, one method of operating the disclosed firearm 20 is illustrated. Starting with FIG. 9, the depicted firearm 20 is shown ready to fire. A locking block 65 is forced outwardly, in relation to the center longitudinal axis of the firearm 20, by a bolt 48 moving forward under spring 47 force into battery via two cam tracks 60*a* and 60*b* of the locking block 65. A cartridge 37 is chambered. The barrel 43 is at its rearmost position wherein a flange 61 of the barrel 43 is in contact with the front of the trunnion 62. The trigger 29 has not yet been pulled. A sear 30 is holding a sprung striker 41 at its rearmost position within a bolt assembly 85. A buffer piston 44 is protruding through a hole in the bolt assembly end cap 45 and a buffer spring 88 is uncompressed.

Figure 10:
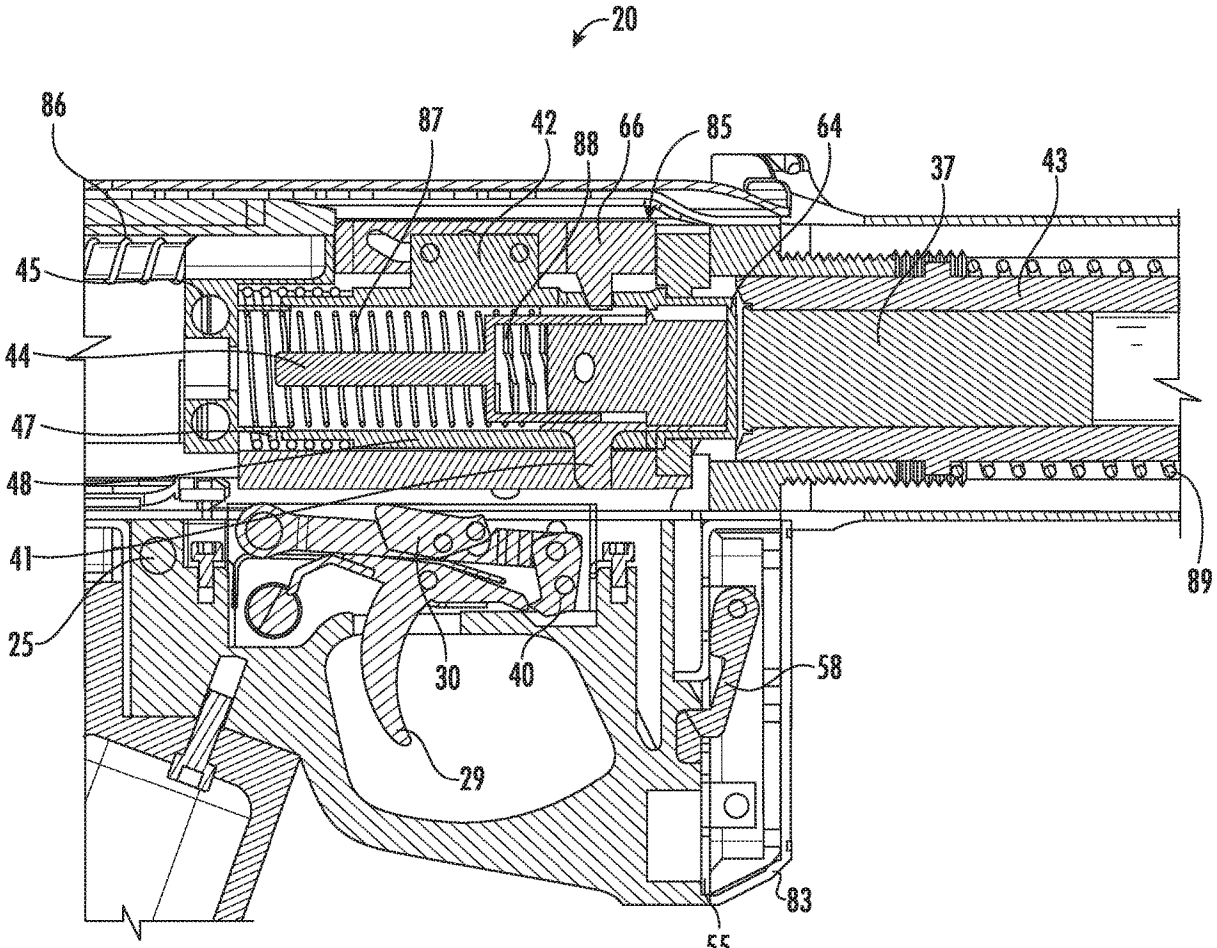
FIG. 10 is a partial side sectional view of an ambidextrous compact firearm constructed in accordance with the teachings of the present disclosure.

Turning to FIG. 10, the depicted firearm 20 is firing. The trigger 29 is pulled, the sear 30 drops and the disconnector 40 follows its cam track 59 to separate from the trigger 29. The striker spring 87 forces the striker 41 forward and the striker 41 impacts the inside face 64 of the bolt 48 and simultaneously impacts the cartridge's primer with the firing pin 46 of the striker 41, causing the bullet to discharge. The striker 41 simultaneously pushes the bolt 48, barrel 43, and cartridge 37 forward, all in one motion, in order to delay the breech unlocking. If the out-of-battery safety 66 is in its inward position, the striker 41 is unable to detonate the cartridge 37. The out-of-battery safety 66 wedge shape is configured to allow the striker 41 to cam it outwardly in order to clear the path for the striker 41 and to force the firearm 20 to lock and become safe.

Figure 11:
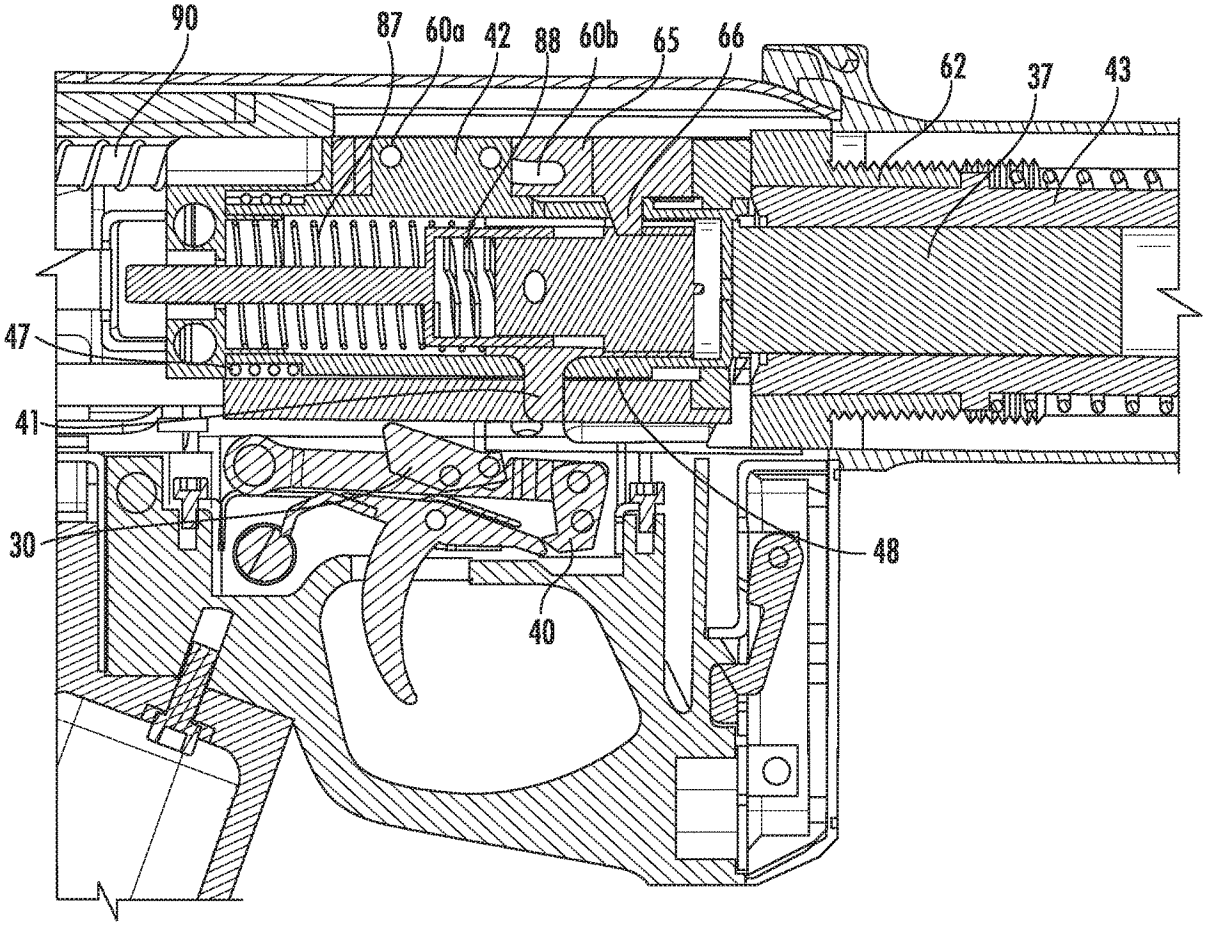
FIG. 11 is a partial side sectional view of an ambidextrous compact firearm constructed in accordance with the teachings of the present disclosure.

Turning to FIG. 11, the depicted firearm 20 is unlocking and extracting the spent casing. The barrel 43 has overcome the inertia of the striker 41 and the inertia of the bolt 48 pushing forward, and the barrel 43 has reciprocated backwards until its flange 61 is in contact with the trunnion 62. The casing, under residual gas pressure from firing, pushes the bolt 48 rearwardly into the bolt carrier. This causes the firearm 20 to unlock, via a two pin lug on the bolt 48, camming the locking block 65 inward and out of engagement with the locking plate 42 in the receiver 63. The out-of-battery safety 66 cams the striker 41 rearwardly, which prevents the striker 41 from contacting the primer. The sear 30 and disconnector 40 move back inwardly towards the center of the firearm 20 via a torsion spring.

Figure 12:
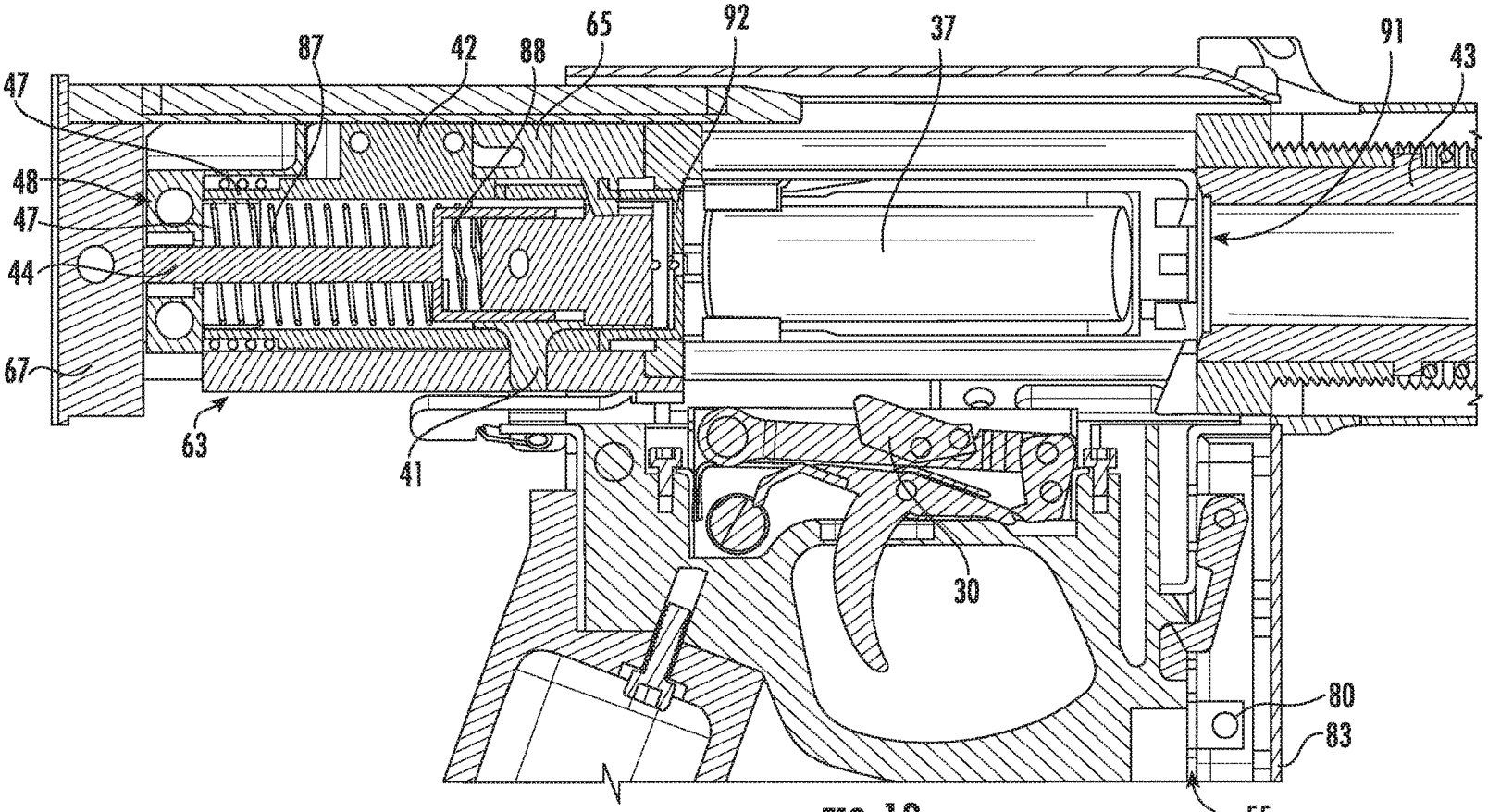
FIG. 12 is a partial side sectional view of an ambidextrous compact firearm constructed in accordance with the teachings of the present disclosure.
Figure 13:
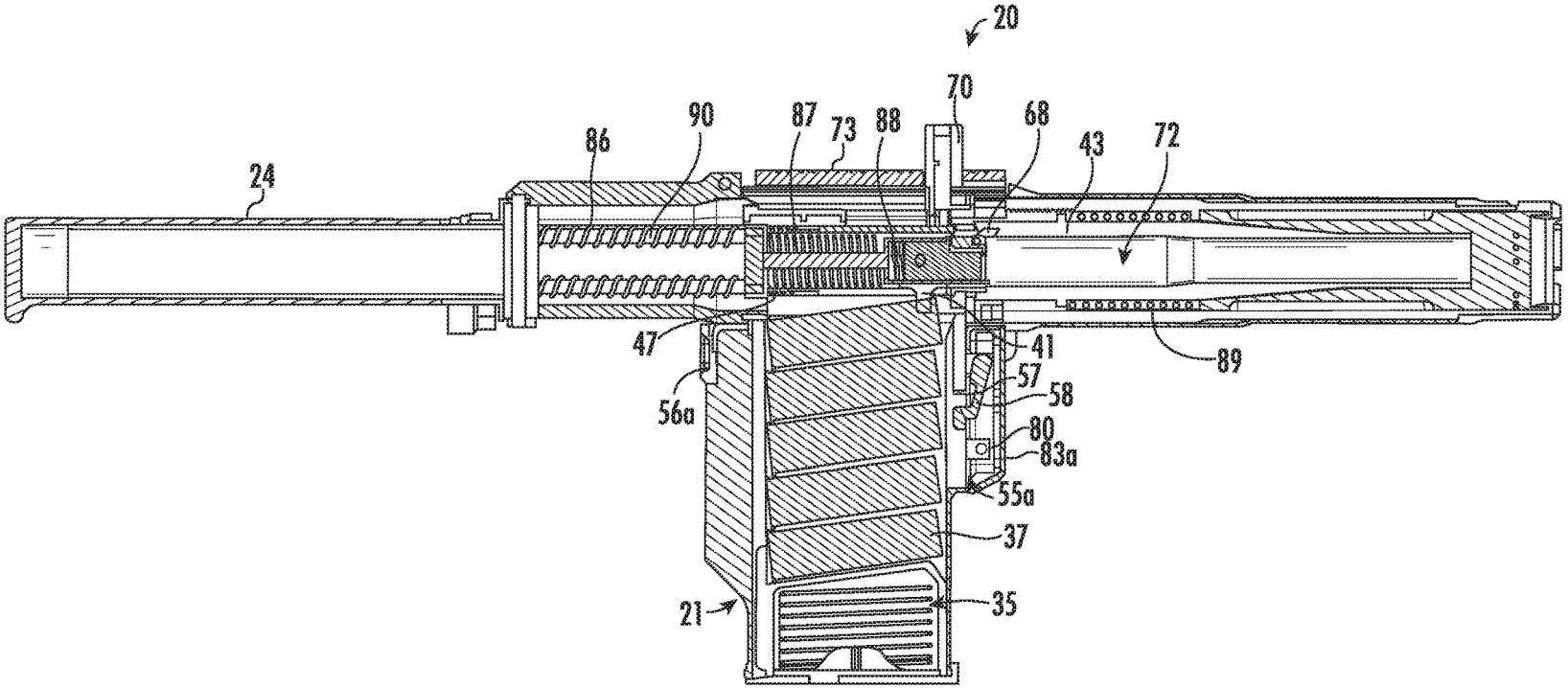
FIG. 13 is a side sectional view of an ambidextrous compact firearm constructed in accordance with the teachings of the present disclosure.
Figure 14:
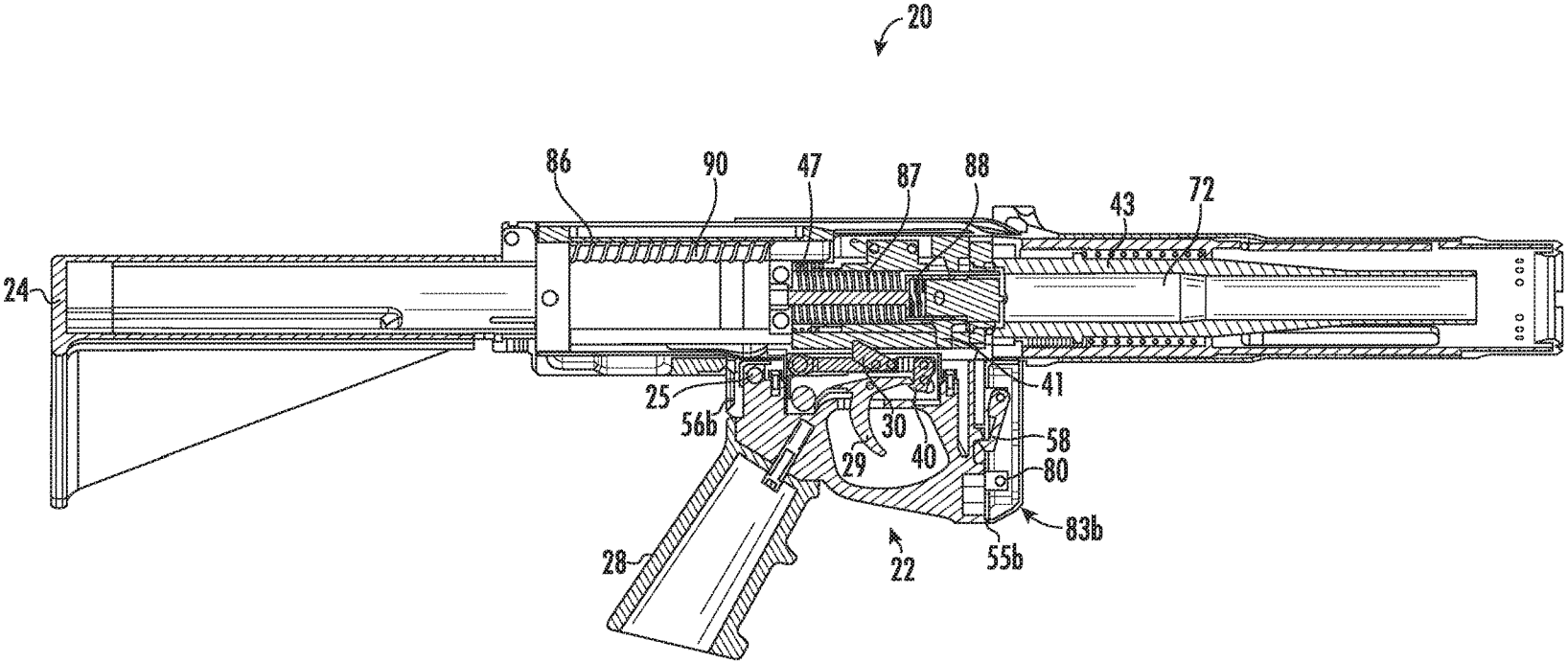
FIG. 14 is a side sectional view of an ambidextrous compact firearm constructed in accordance with the teachings of the present disclosure.
Figure 15:
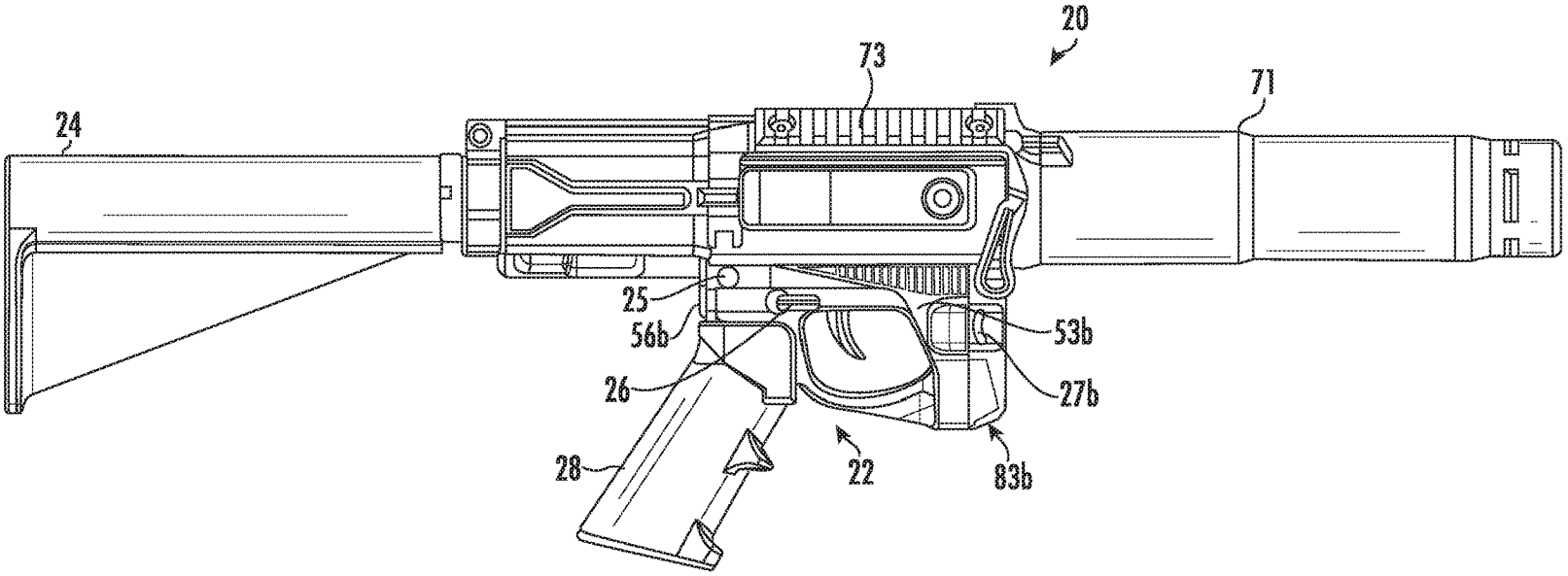
FIG. 15 is a right side perspective view of the firearm shown in FIG. 1.
Figure 16:
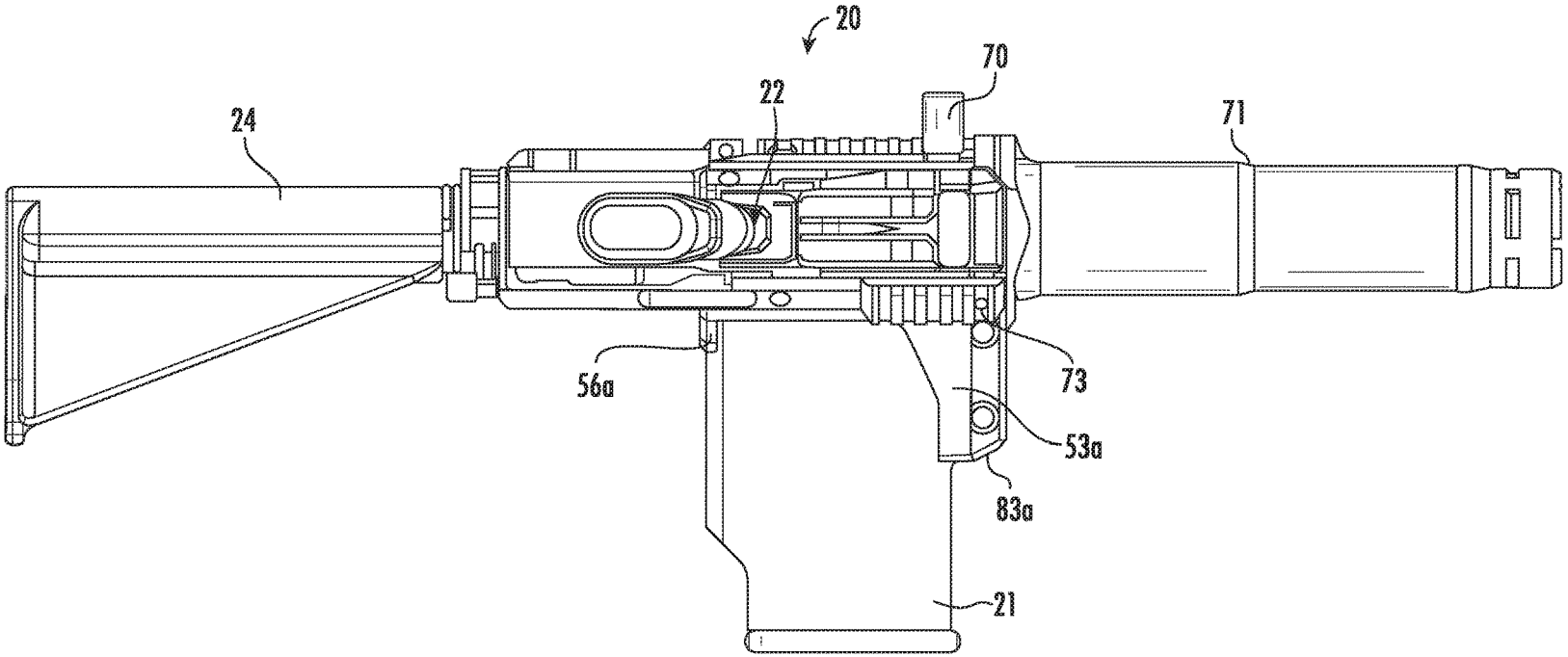
FIG. 16 is a bottom perspective view of the firearm shown in FIG. 1.
Figure 17:
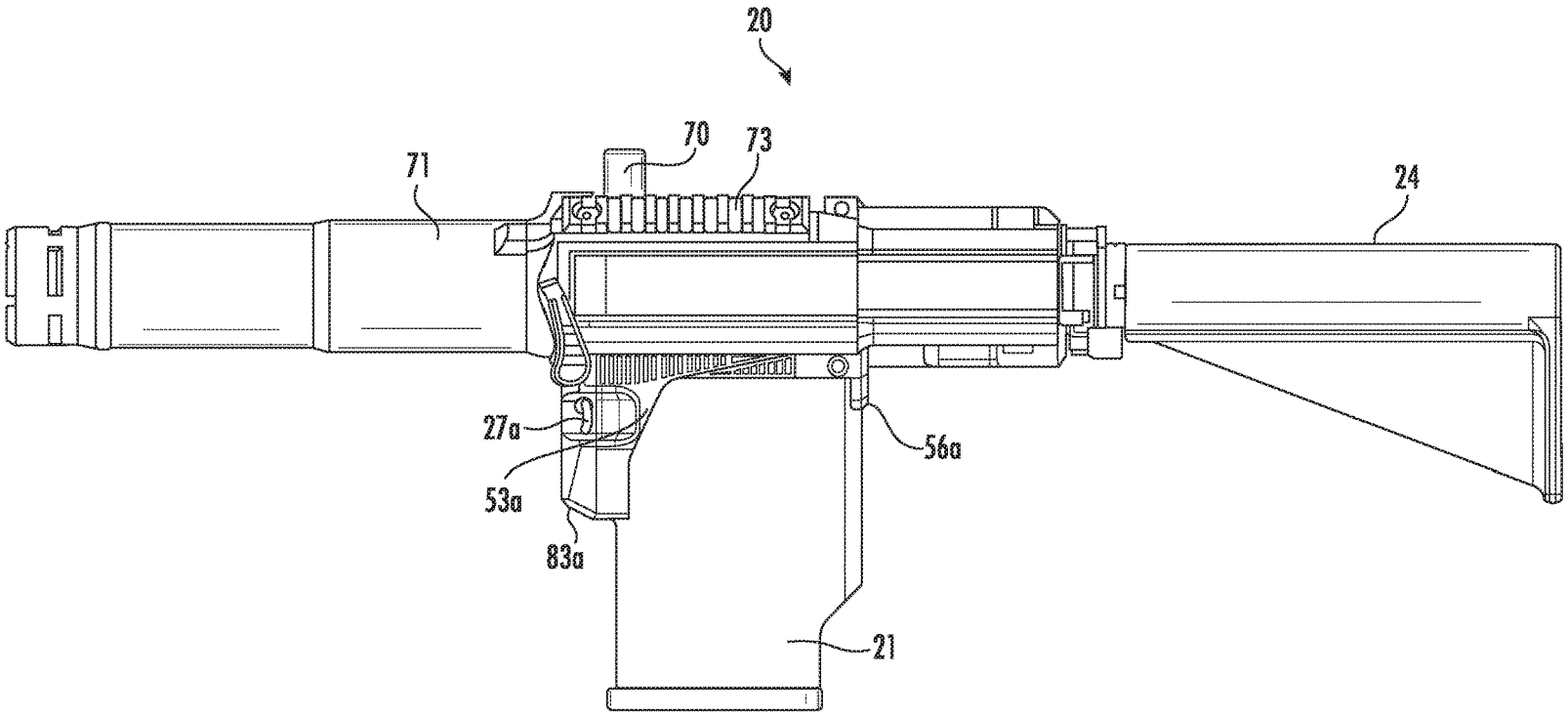
FIG. 17 is a left side perspective view of the firearm shown in FIG. 1.
Figure 18:
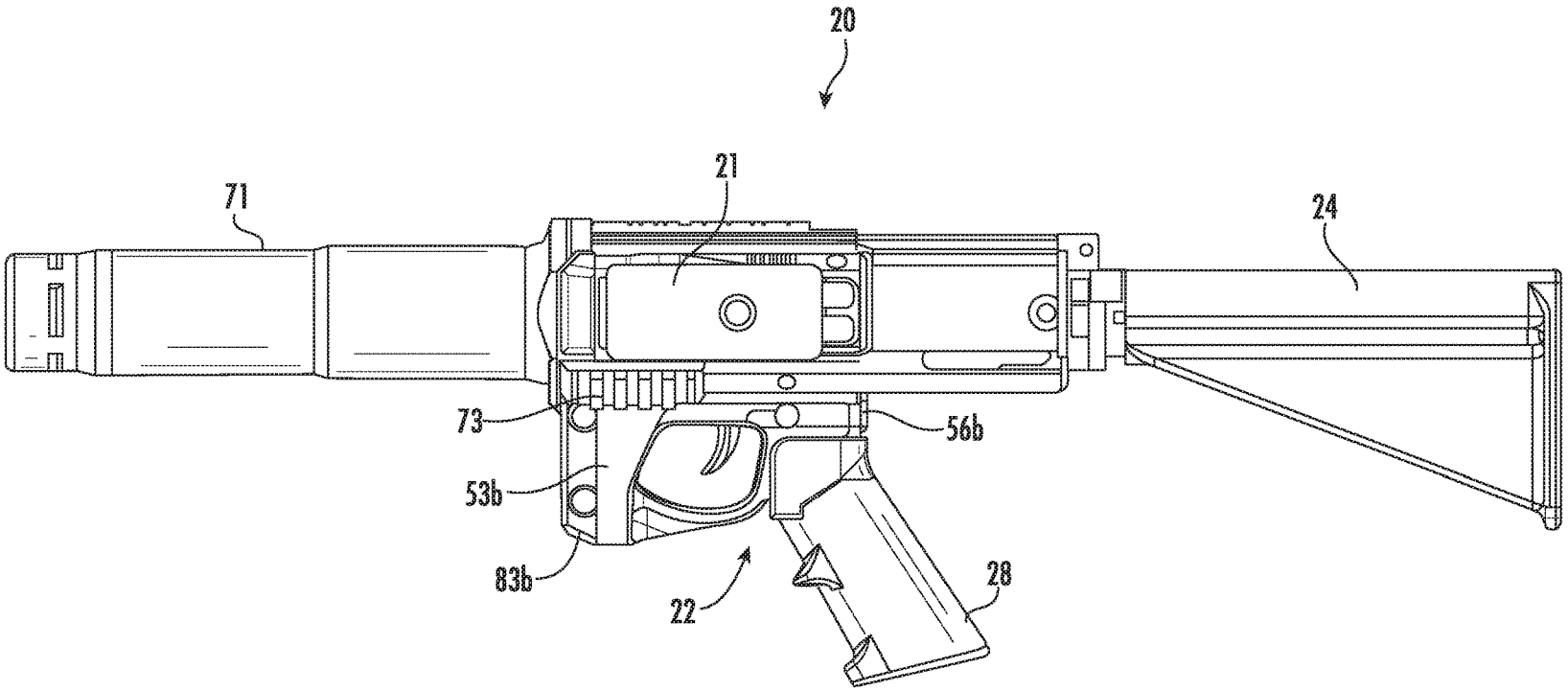
FIG. 18 is a bottom perspective view of the firearm shown in FIG. 1.

Finally, FIG. 12 depicts the full rearward travel of the bolt 48 and the ejection of the shell. The bolt 48 fully compresses its two main springs 86 and the bolt 48 is at its rearwardmost point of travel within the receiver 63. The buffer piston 44 impacts the receiver end plate 67 and compresses its stiff buffer spring 88, thereby absorbing recoil forces and preventing the bolt assembly 85 from impacting the receiver end plate 67. The compression of the buffer piston 44 simultaneously causes the ejector to protrude out the front of the bolt face 92, impacts one side of the rear of the casing, rotates the casing around the extractor 68, and ejects the casing out of the ejection port 69. The locking block 65 stays in an inward position, unlocked from the receiver 63, as the locking plate 42 prevents the locking block 65 from camming outwardly. Simultaneously, the locking block 65 being in its inward position, locks the bolt 48 in a fully retracted position in the bolt carrier and keeps the striker 41 in a safe position. In this manner, the disclosed ambidextrous compact firearm 20, chambers a cartridge 37, fires a bullet and ejects an empty casing.

It is important to note that the construction and arrangement of the elements of the apparatus provided herein are illustrative only. Although only a few exemplary embodiments of the present invention have been described in detail in this disclosure, those skilled in the art who review this disclosure will readily appreciate that many modifications are possible in these embodiments (such as variations in orientation of the components of the system, sizes, structures, shapes and proportions of the various components) without materially departing from the novel teachings and advantages of the invention.

Though the disclosed firearm is illustrated in the accompanying Figures as a shotgun, note that it is not intended to limit the spirit and scope of the present invention solely for use with shotguns. Many other uses of the present invention will become obvious to one skilled in the art upon acquiring a thorough understanding of the present invention. Once given the above disclosures, many other features, modifications and variations will become apparent to the skilled artisan in view of the teachings set forth herein. Such other uses, features, modifications and variations are, therefore, considered to be a part of this invention, the scope of which is to be determined by the following claims.

The invention claimed is:

1. A firearm, comprising:

a barrel;

a receiver coupled to said barrel;

a first interchangeable receiving well coupled to said receiver, wherein said first interchangeable receiving well interchangeably receives a releasably attachable magazine and a releasably attachable fire control group; and a second interchangeable receiving well coupled to said receiver, wherein said second interchangeable receiving well interchangeably receives said releasably attachable magazine and said releasably attachable fire control group.

2. The firearm according to claim 1, wherein said first interchangeable receiving well and said second interchangeable receiving well each comprise:

a first side track;

a second side track opposite said first side track, wherein said second side track extends parallel to said first side track;

a forward track connecting said first side track and said second side track;

a rear track connecting said first side track and said second side track, wherein said rear track is opposite of and extends parallel to said forward track; and a receiving cavity defined as the space formed between said first side track, said forward track, said second side track and said rear track, wherein said receiving cavity interchangeably receives said magazine and said fire control group.

3. The firearm according to claim 1, wherein said receiver further comprises:

an upper left-hand flat, comprising a surface on which a stock of said firearm can fold;

an upper right-hand flat comprising an ejection port;

a lower left-hand flat, wherein said first interchangeable receiving well is disposed; and a lower right-hand flat, wherein said second interchangeable receiving well is disposed.

4. The firearm according to claim 1, wherein said first interchangeable receiving well is identical to said second interchangeable receiving well.

5. The firearm according to claim 1, wherein said first interchangeable receiving well and said second interchangeable receiving well are affixed to said receiver in side-by-side relation at the same location along the longitudinal axis of said receiver.

6. The firearm according to claim 1, wherein said first interchangeable receiving well and said second interchangeable receiving well are affixed to a forward portion of said receiver.

7. The firearm according to claim 1, further comprising a first receiving well retention and release fastener, wherein said first receiving well retention and release fastener releasably retains said magazine or said fire control group in engagement with said first interchangeable receiving well, and a second receiving well retention and release fastener, wherein said second receiving well retention and release fastener releasably retains said magazine or said fire control group in engagement with said second interchangeable receiving well.

8. The firearm according to claim 1, wherein said first interchangeable receiving well comprises:

a body including a forward track extending outwardly from said firearm, a rear track extending outwardly from said firearm wherein said rear track is opposite of and extends parallel to said forward track, a first side track extending outwardly from said firearm wherein said first side track connects said forward track and said rear track, and a second side track extending outwardly from said firearm wherein said second side track is opposite of and extends parallel to said first side track and wherein said second side track connects said forward track and said rear track; and a receiving cavity defining a cavity surrounded by said forward track, said first side track, said rear track and said second side track, wherein said receiving cavity interchangeably receives said releasably attachable magazine and said releasably attachable fire control group.

9. The firearm according to claim 8, wherein said body of said first interchangeable receiving well further comprises a tab, wherein said tab prevents over-insertion of said fire control group or said magazine in said first interchangeable receiving well.

10. The firearm according to claim 8, wherein said first interchangeable receiving well further includes a first mounting base disposed in front of said forward track, wherein said forward track is affixed to said first mounting base.

11. The firearm according to claim 10, wherein said forward track includes a coupling tongue member coupling said first interchangeable receiving well to said first mounting base.

12. The firearm according to claim 10, wherein said forward track includes one or more coupling tabs coupling said first interchangeable receiving well to said first mounting base.

13. The firearm according to claim 12, wherein said one or more coupling tabs each include an aperture therethrough, wherein said aperture receives a fastener therethrough to fasten said one or more coupling tabs to said first mounting base.

14. The firearm according to claim 12, further comprising a receiving well retention and release fastener, wherein said receiving well retention and release fastener releasably retains said magazine or said fire control group in engagement with said first interchangeable receiving well, and wherein said receiving well retention and release fastener is attached to said firearm by fastening to said one or more coupling tabs.

15. The firearm according to claim 8, further comprising a receiving well retention and release fastener defining a lever and including a head, wherein said head couples with said magazine or said fire control group to releasably retain the magazine or the fire control group in engagement with said first interchangeable receiving well, and wherein said head disengages from engagement with said magazine or said fire control group to release the magazine or the fire control group from engagement with said first interchangeable receiving well, and wherein said forward track further comprises an aperture receiving said head of said receiving well retention and release fastener and allowing said head to releasably couple with said magazine or said fire control group.

16. The firearm according to claim 8, wherein said second interchangeable receiving well comprises:

a body including a forward track extending outwardly from said firearm, a rear track extending outwardly from said firearm wherein said rear track is opposite of and extends parallel to said forward track, a first side track extending outwardly from said firearm wherein said first side track connects said forward track and said rear track, and a second side track extending outwardly from said firearm wherein said second side track is opposite of and extends parallel to said first side track and wherein said second side track connects said forward track and said rear track; and a receiving cavity defining a cavity surrounded by said forward track, said first side track, said rear track and said second side track, wherein said receiving cavity interchangeably receives said releasably attachable magazine and said releasably attachable fire control group.

17. The firearm according to claim 16, wherein said body of said second interchangeable receiving well further comprises a tab, wherein said tab prevents over-insertion of said fire control group or said magazine in said first interchangeable receiving well.

18. The firearm according to claim 16, wherein said second interchangeable receiving well further includes a second mounting base disposed in front of said forward track, wherein said forward track is affixed to said second mounting base.

19. The firearm according to claim 18, wherein said forward track includes a coupling tongue member coupling said first interchangeable receiving well to said second mounting base.

20. The firearm according to claim 18, wherein said forward track includes one or more coupling tabs coupling said second interchangeable receiving well to said second mounting base.

21. The firearm according to claim 20, wherein said one or more coupling tabs each include an aperture therethrough, wherein said aperture receives a fastener therethrough to fasten said one or more coupling tabs to said second mounting base.

22. The firearm according to claim 20, further comprising a receiving well retention and release fastener, wherein said receiving well retention and release fastener releasably retains said magazine or said fire control group in engagement with said second interchangeable receiving well, and wherein said receiving well retention and release fastener is attached to said firearm by fastening to said one or more coupling tabs.

23. The firearm according to claim 20, further comprising a receiving well retention and release fastener defining a lever and including a head, wherein said head couples with said magazine or said fire control group to releasably retain the magazine or the fire control group in engagement with said second interchangeable receiving well, and wherein said head disengages from engagement with said magazine or said fire control group to release the magazine or the fire control group from engagement with said second interchangeable receiving well, and wherein said forward track further comprises an aperture receiving said head of said receiving well retention and release fastener and allowing said head to releasably couple with said magazine or said fire control group.

24. The firearm according to claim 1, wherein said fire control group comprises:

a trigger group;

a handgrip; and a mating frame attached to said handgrip, said mating frame housing said trigger group, wherein said mating frame interchangeably mates with said first interchangeable receiving well and said second interchangeable receiving well.

25. The firearm according to claim 24, further comprising:

a first receiving well retention and release fastener, wherein said first receiving well retention and release fastener releasably retains said magazine or said fire control group in engagement with said first interchangeable receiving well; and a second receiving well retention and release fastener, wherein said second receiving well retention and release fastener releasably retains said magazine or said fire control group in engagement with said second interchangeable receiving well;

wherein said mating frame further comprises:

a forward face that interchangeably couples with said first receiving well retention and release fastener and with said second receiving well retention and release fastener;

a top face that couples with said receiver; and a rear portion comprising an aperture for receiving a fire control group retaining pin therethrough.

26. The firearm according to claim 25, wherein said first interchangeable receiving well further comprises:

a first side track; and a second side track opposite said first side track, wherein said second side track extends parallel to said first side track;

wherein said retaining pin is inserted through an aperture formed through said first side track and said retaining pin is inserted through said aperture formed through said rear portion of said mating frame and said retaining pin is inserted through an aperture formed through said second side track.

27. The firearm according to claim 26, further comprising a receiving slot formed on a bottom portion of said firearm between said first interchangeable receiving well and said second interchangeable receiving well, wherein said receiving slot receives an end portion of said fire control group retaining pin.

* * * * *